US008141394B2

(12) United States Patent
Brandl

(10) Patent No.: US 8,141,394 B2
(45) Date of Patent: Mar. 27, 2012

(54) KNITTING TOOL ARRANGEMENT AND KNITTING TOOL

(75) Inventor: Klaus Brandl, Hainburg (DE)

(73) Assignee: Karl Mayer Textilmaschinenfabrik GmbH, Obertshausen (DE)

( * ) Notice: Subject to any disclaimer, the term of this patent is extended or adjusted under 35 U.S.C. 154(b) by 318 days.

(21) Appl. No.: 12/204,253

(22) Filed: Sep. 4, 2008

(65) Prior Publication Data

US 2009/0084142 A1 Apr. 2, 2009

(30) Foreign Application Priority Data

Oct. 2, 2007 (EP) ..... 07019328

(51) Int. Cl.
*D04B 35/02* (2006.01)

(52) U.S. Cl. ..... 66/123

(58) Field of Classification Search ..... 66/116, 66/119, 120, 121, 123, 124
See application file for complete search history.

(56) References Cited

U.S. PATENT DOCUMENTS

| | | | | |
|---|---|---|---|---|
| 1,221,806 | A * | 4/1917 | Scott | 66/115 |
| 1,496,341 | A * | 6/1924 | Kochenderfer | 66/114 |
| 2,024,911 | A * | 12/1935 | Crawford | 66/124 |
| 3,783,646 | A | 1/1974 | Naumann et al. | |
| 4,603,561 | A * | 8/1986 | Berger et al. | 66/203 |
| 4,665,717 | A * | 5/1987 | Atsushi | 66/122 |
| 5,097,683 | A * | 3/1992 | Schuler et al. | 66/121 |
| 5,544,501 | A | 8/1996 | Hagel | |
| 6,807,831 | B2 * | 10/2004 | Roth | 66/123 |
| 7,334,436 | B2 * | 2/2008 | Stingel et al. | 66/123 |
| 7,624,599 | B2 * | 12/2009 | Dietz et al. | 66/123 |
| 2008/0271497 | A1 | 11/2008 | Jurgens et al. | |

FOREIGN PATENT DOCUMENTS

| | | |
|---|---|---|
| DE | 21 33 366 | 12/1972 |
| DE | 44 14 703 | 10/1995 |
| EP | 1 988 199 | 11/2008 |

* cited by examiner

*Primary Examiner* — Larry Worrell, Jr.
(74) *Attorney, Agent, or Firm* — Greenblum & Bernstein, P.L.C.

(57) ABSTRACT

Knitting tool arrangement, knitting tool and method of forming the knitting tool arrangement that includes a tool holder having several parallel grooves and several knitting tools, in which each knitting tool includes a working end and a holding area that is removably positioned in one of the several grooves. At least one filling element is located between adjacent knitting tools and is arranged between the holding area and the working end. The instant abstract is neither intended to define the invention disclosed in this specification nor intended to limit the scope of the invention in any way.

25 Claims, 2 Drawing Sheets

KNITTING TOOL ARRANGEMENT AND KNITTING TOOL

CROSS-REFERENCE TO RELATED APPLICATIONS

The present application claims priority under 35 U.S.C. §119 of European Patent Application No. 07 019 328.9 filed Oct. 2, 2007, the disclosure of which is expressly incorporated by reference herein in its entirety.

BACKGROUND OF THE INVENTION

1. Field of the Invention

The invention relates to a knitting tool arrangement with a tool holder having several parallel grooves and several knitting tools. Each of the knitting tools has a holding area that is arranged in one of the grooves and a working end.

Furthermore, the invention relates to a knitting tool with two side flanks, a holding area and a working end.

2. Discussion of Background Information

The invention is described below based on a knitting needle, in particular a slide needle, as an example of a knitting tool. However, it can also be used in a corresponding manner with other knitting tools that are involved in a loop-forming process in a knitting machine.

The knitting needles are inserted in grooves of a bar. Webs are provided between the grooves to provide a predetermined spacing between adjacent knitting needles and to support the knitting needles laterally.

The knitting needles are often held in the bar by covers or other holding elements.

With a loop formation, i.e., during operation of the knitting machine, certain stresses act on the knitting needles, in particular lateral thread tensions. The knitting needles must therefore be stable enough to withstand these tensions without deforming beyond a certain extent.

The finer the knitted article is to be, the more closely adjacent the knitting needles must be. The number of knitting needles per inch (25.4 mm) is also referred to as "gauge." Up to a gauge of E36, i.e., 36 needles per inch, conventional techniques are sufficient for embodying or forming the knitting needles and the tool holder, i.e., the bar, in a manner stable enough for the needles to be able to withstand the forces occurring during loop formation.

However, if the gauge is higher, the number of knitting needles also increases, such that the width or thickness of the webs between the grooves must be reduced so much that these webs can no longer guarantee sufficient lateral support force. Under unfavorable circumstances the webs are so weak that they break when lateral drafting forces act on the needles. Another disadvantage is that the webs can be damaged during straightening of the knitting needles, since as a rule a lateral pressure is exerted on the webs during straightening. There is also the risk that the weak groove webs will be damaged during a replacement of a damaged knitting needle.

If the thickness of the knitting needles were simply reduced, this would lead to the disadvantage of the knitting needle losing its lateral stability. The laterally acting thread tension would draw the knitting needle with its knitting head laterally out of its position, thereby risking collision with the guide needles. Furthermore, it is foreseeable that a knitted article with reduced quality may be produced with a knitting needle being deformed in an uncontrolled manner.

SUMMARY OF THE INVENTION

The present invention provide the highest possible gauge with a knitted article.

According to the invention, a knitting tool arrangement of the type mentioned at the outset includes at least one filling element provided between adjacent knitting tools. The filling element is arranged between the holding area and the working end.

Adjacent knitting tools can support one another, as it were, through the filling element. Through this measure, the thickness of the knitting needles (or of another knitting tool) can be substantially reduced without having a negative impact on the loadability of the knitting needles. Although it is accepted that the end of the working area projecting over the filling element is deformed, since the length available for the deformation has been substantially reduced by the filling element, a deformation of this type is still acceptable. The risk of a collision with eye needles or a deterioration of the quality of the knitted article is still bearable. Moreover, a thinner but supported knitting needle has the advantage that a favorable ratio of needle thickness to width of the dent bar of the knock-over sinker results. This means that a sufficiently large free space remains from the lateral flanks of the knitting needles to the lateral flanks of the sinkers. The risk of collision during the knitting process is thus reduced, even if a certain thermal expansion results. An additional advantage is that a thinner knitting needle also has a lower mass, which has a positive impact on the stress on the needle bar and its control elements. The additional mass entailed by the filling element can be disregarded in this context. Another advantage results in that a complex straightening of the knitting needles with respect to one another can be omitted or in any case is simplified, since the support and thus the forced positioning of the knitting needles takes place in an area that is arranged closer to the working area, i.e., to the needle tip. Narrower grooves also result with thinner needles, the consequence of which is that the webs between the grooves remain correspondingly thicker and thus more stable, so that they can better absorb the lateral stresses of the knitting needles.

Preferably, the filling element fills a clearance between adjacent knitting needles with an allowance. Thus, a small gap is provided having a size of a few hundredths of a millimeter, which serves among other things to compensate for any thermal expansions of the knitting needles. Furthermore, the gap facilitates the removal and the installation of knitting needles on the bar or another tool holder.

The filling element is preferably arranged on a side flank of the knitting tool and leaves a front flank free. Thus, the front flank remains freely accessible, which is advantageous, for example, with a slide needle, because the slide can be influenced here.

The filling element is preferably attached to a knitting tool. The filling element is thus automatically also positioned with an installation of the knitting tool in the tool holder. The filling element is automatically located at the correct position relative to the knitting tool.

The knitting tool preferably has two filling elements on side flanks facing away from one another. Each filling element then bridges essentially half of the space between two knitting tools. In this manner, all of the knitting tools to be attached to a bar or another tool holder can be embodied or formed identically, which facilitates assembly.

The filling element is preferably formed by a thickening of the knitting tool. A thickening of this type can already be shaped during the production of the knitting tool. In this manner, the filling element or the filling elements can be formed in one piece with the knitting tool, such that the filling element or elements are, as it were, non-detachable.

Alternatively, the filling element can be clipped, adhered, sprayed, soldered or welded onto the knitting tool. In this case, the filling element can include a different material from the knitting tool. For example, the filling element can be made of a plastic that has a lower specific weight than the material of the knitting tool. A relatively simple possibility is to use a film matched to the size of the clearance between two knitting tools, which film is adhered onto the side flank of the knitting tool. A plastic spray process can also be used to spray a filling element at or on the knitting needle.

The filling element can also be shaped out of the knitting tool. This can be carried out by embossing, stamping or deep-drawing. In this case, the mass of the knitting tool is not increased by the filling element, since the filling element is formed in one piece with the knitting tool.

Another embodiment is formed in that several filling elements are connected to one another. For example, a plastic web can be used that at the same time fixes the knitting tools at a predetermined spacing with respect to one another. A plastic web of this type facilitates assembly.

The filling element preferably bears against the tool holder. The filling element is then additionally used for a positioning of the knitting tool on the holder. An abutting piece is advantageous in particular in the area of the side flanks.

According to the invention, a knitting tool of the type mentioned at the outset includes at least one filling element on at least one side flank between the holding area and the working end.

When the knitting tool is installed in the tool holder, the filling element ensures that adjacent knitting tools can support one another in the case of a lateral tensile force, which can occur during a loop formation. The free length available for a deformation on the knitting tool is reduced by the filling element. The term "filling element" is meant functionally here, i.e., it does not need to be an independent body that is arranged between the knitting tools. Since the filling element is arranged between the holding area and the working end, it is located outside the grooves in the installed state of the knitting tool. The thickness of the knitting tool can thus be reduced, which produces the advantages listed above in connection with the knitting tool arrangement.

The filling element is preferably formed by a thickening of the knitting tool. A thickening of this type can already be shaped during the production of the knitting tool. The thickening is embodied or formed in one piece with the knitting tool, i.e., it is held in a non-detachable manner.

In an alternative embodiment, the filling element can be clipped, adhered, sprayed, soldered or welded onto the knitting tool. In any case, a reliable connection results between the knitting tool and the filling element.

It can also be provided that the filling element is shaped out of the knitting tool. To this end, the knitting tool can be, e.g., embossed, stamped or deep drawn. In this case, the filling element is held on the knitting tool in a non-detachable manner, and does not cause an increase in mass of the knitting tool.

The filling element preferably leaves one front flank free. Thus, the front flank is available so that, for example, with a slide needle the slide is freely accessible despite the filling element present.

The invention is directed to a knitting tool arrangement that includes a tool holder having several parallel grooves and several knitting tools, in which each knitting tool includes a working end and a holding area that is removably positioned in one of the several grooves. At least one filling element is located between adjacent knitting tools and is arranged between the holding area and the working end.

In accordance with a feature of the invention, the at least one filling element can be structured to fill, with an allowance, a clearance between the adjacent knitting tools.

According to another feature, the at least one filling element may be arranged on a side flank of the knitting tool, whereby an other side flank is free of the at least one filling element.

Moreover, the at least one filling element may be attached to the knitting tool. The at least one filling element can include two filling elements located on side flanks of the knitting tool to face away from one another.

In accordance with still another feature of the present invention, the at least one filling element can be formed by a thickening of the knitting tool.

According to another feature of the instant invention, the at least one filling element may be at least one of clipped, adhered, sprayed, soldered or welded onto the knitting tool.

According to still another feature of the invention, the at least one filling element may be shaped out of the knitting tool.

Still further, the at least one filling element can include at least two filling elements connected to one another.

According to a further feature of the instant invention, the at least one filling element can bears against the tool holder.

The invention is directed to a knitting tool including two side flanks, a holding area, a working end, and at least one filling element located on at least one of the two side flanks, between the holding area and the working end.

According to a feature of the invention, the at least one filling element can be formed by a thickening of the side flanks.

In accordance with another feature of the present invention, the at least one filling element may be at least one of clipped, adhered, sprayed, soldered or welded onto the at least one of the two side flanks.

According to still another feature, the at least one filling element can be shaped out of the two side flanks.

Further, the at least one filling element may be structured and arranged to leave one of the two flanks free.

The invention is directed to a method of forming a knitting tool arrangement. The method includes forming at least one filling element on each of a plurality of knitting tools, such that the at least one filling element is formed between a working end and a holding area of the knitting tools, and positioning the plurality of knitting tools into a plurality of grooves in a tool holder so that the at least one filling element is located between adjacent knitting tools.

According to a feature of the instant invention, each of the plurality of knitting tools have two side flanks, and the forming of the at least one filling element can include forming one filling element on only one of the two side flanks.

In accordance with another feature of the invention, each of the plurality of knitting tools have two side flanks, and the forming of the at least one filling element may include forming one filling element on each of the two side flanks.

Further, the forming of the at least one filling element may include shaping the at least one filling element from the knitting tool.

In accordance with still yet another feature of the present invention, each of the plurality of knitting tools can include a foot extending from an end of the holding area opposite the at least one filling element, and the tool holder can include a projection in which the plurality of grooves are formed, and the projection has a length, in a direction of the grooves, corresponding to a distance between a top of the foot and a surface of the at least one filling element facing the foot, in order to clamp the knitting tools into the grooves of tool holder.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
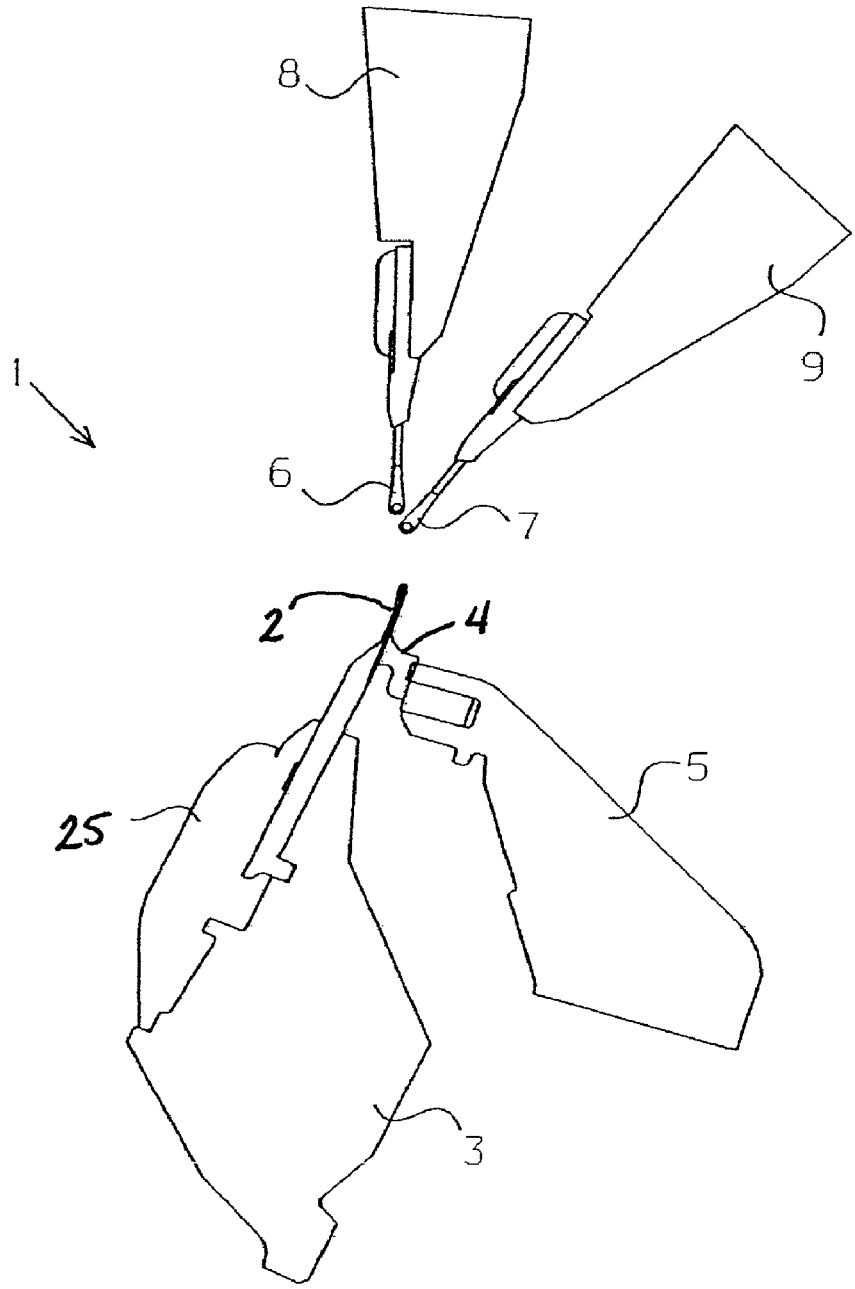
FIG. 1 illustrates a highly schematized representation of a section of a knitting machine.

FIG. 1 shows schematically a section from a knitting machine 1, i.e., the knitting area of the knitting machine 1.

Knitting needles 2 are attached to a knitting needle bar 3. Knitting needles 2 are embodied of formed as slide needles. In order to activate the slide of knitting needles 2, a slide (or knock-over) sinker 4 is provided, which is attached to a sinker bar 5.

To form a loop, threads are guided via eye needles 6 and 7, which for their part are arranged on guide rails 8 and 9.

Knitting needles 2 as well as eye needles 6 and 7 are present in multiples. They are arranged one behind the other in a direction perpendicular to the drawing plane, so that respectively only one element is discernible in the representation of FIG. 1.

The finer the knitted article is to be, the more closely adjacent to one another knitting needles 2 must be. The number of knitting needles 2 per inch (2.54 mm) is also referred to as the "gauge." A gauge of E24 means that 24 knitting needles per inch are provided. A gauge of E36, i.e., 36 knitting needles per inch, can still be achieved with conventional knitting elements.

Figure 2:
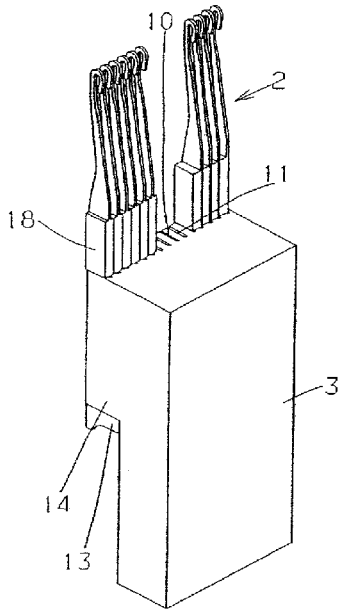
FIG. 2 illustrates a knitting needle bar in perspective representation from the front.
Figure 3:
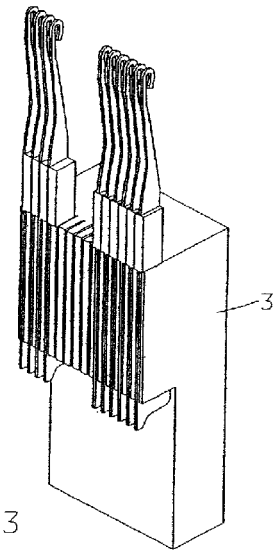
FIG. 3 illustrates the knitting needle bar in perspective representation from behind.

As is discernible from FIGS. 2 and 3, knitting needles 2 are arranged in grooves 10 that are located in knitting needle bar 3. Knitting needles 2 are held there by a cover 25. Webs 11 are embodied or formed between grooves 10. The higher the gauge, the narrower webs 11 must be. While usually all of grooves 10 are occupied by knitting needles 2, for ease of illustration and explanation, several knitting needles 2 have been omitted from the illustrated embodiments in FIGS. 2 and 3. However, it is understood that generally a knitting needle 2 would be located in each groove 10 in knitting needle bar 3.

Holding area 12 of knitting needles 2 are removably insertable into grooves 10. A foot 13 is located on a lower end 26 (see FIG. 4) of holding area 12, such that, when knitting needle 2 is in groove 10, foot 13 is arranged to bear against a projection 14 of knitting needle bar 3 from below. A working end or area 17 located opposite lower end 26 includes a needle tip 15, which can be bent in a hook-like manner so as to be able to grasp a thread. In a manner not shown in further detail, but known per se, an opening 16, which may be embodied or formed on needle tip 15, can be closed by a slide that is operated by slide sinker 4.

During operation, lateral forces act on knitting needles 2 in the loop formation. With a high gauge, e.g., greater than E36 (gauge>E36), the thickness of knitting needles 2 is reduced to avoid having to reduce the width of webs 11 too much. However, when a thickness of knitting needles 2 is reduced in this manner, knitting needle 2 may no longer be able to absorb the thread tension occurring during the loop formation without deformation. In this regard, the laterally acting thread tension would draw tip 15 of knitting needle 2 laterally out of its position, risking a collision of knitting needle 2 with eye needles 6 and 7. Furthermore, it is foreseeable that a poor quality of the knitted article produced then results.

In order to remedy this problem, knitting needles 2 are provided with filling elements 18 to almost completely fill a clearance between adjacent knitting needles 2. However, a small allowance remains, e.g., in the order of magnitude of a few hundredths of a millimeter, in order to, e.g., be able to absorb certain thermal expansions of knitting needles 2 and render possible a removal and installation of knitting needles 2 from and into knitting needle bar 3. As is discernible from FIGS. 2 and 3, filling elements 18 of knitting needles 2 stand up on knitting needle bar 3, whereby knitting needles 2 are supported in the movement direction of knitting needle bar 3 through the joint action of filling elements 18 and feet 13.

Filling elements 18 ensure that a free length of knitting needles 2 that could be laterally displaced with a lateral tensile force through thread tension is reduced. Accordingly, although a small deformation is still possible, the deformation is so small that it is acceptable. In the area where filling elements 18 are arranged, knitting needles 2 support one another reciprocally. This has the additional advantage that a complex straightening of knitting needles 2 with respect to one another can be omitted or at any rate is simplified, since the support and thus the forced positioning of knitting needles 2 occurs in a spacing much smaller than tip 15. Knitting needle 2 can thus be embodied or formed with a reduced thickness, which has the advantage that a favorable ratio of needle thickness to dent bar of knock-over sinker 4 results. The result is that sufficient free space remains from lateral flanks 19 and 20 of knitting needle 2 to the lateral flanks of knock-over sinkers 4. In this manner, a risk of collision is thereby reduced even with low thermal expansion. Furthermore, a thinner knitting needle 2 also has a lower mass.

FIGS. 4 through 9 now show different embodiments of respectively one knitting needle 2.

Figure 4:
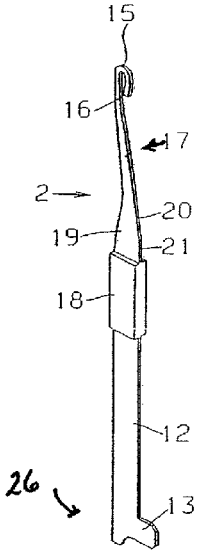
FIG. 4 illustrates a first embodiment of a knitting needle.

In the representation of FIG. 4, filling element 18 is formed by a thickening of knitting needle 2. Filling element 18 is hereby simply formed above holding area 12 by a thickening of shaft 21 of knitting needle 2 during production of knitting needle 2, e.g., by compression.

Figure 5:
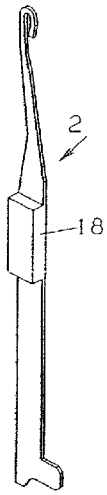
FIG. 5 illustrates a second embodiment of a knitting needle.

FIG. 5 shows a modified embodiment of a knitting needle in which filling element 18, which in contrast to the representation of FIG. 4 where the filling element is arranged on both sides of shaft 21, is arranged on only one side of shaft 21. Further, filling element 18 in FIG. 5 has twice the thickness of either filling element in FIG. 4. While the embodiment according to FIG. 4 utilizes two filling elements 18 in order to bridge a space between two grooves 10, in the embodiment according to FIG. 5, a single filling element 18 takes on this function, and strikes against the adjacent knitting needle 2 upon a slight lateral movement of knitting needle 2.

Figure 6:
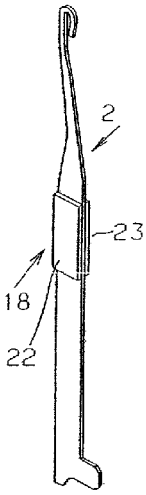
FIG. 6 illustrates a third embodiment of a knitting needle.

In the embodiment according to FIG. 6, filling element 18 is embodied or formed by two adhered plastic parts 22 and 23. These plastic parts can also be a film. The two parts 22 and 23 can also be sprayed on, sprayed at or clipped on. In this embodiment, filling elements 18 are provided on both side flanks of knitting needle 2.

Figure 7:
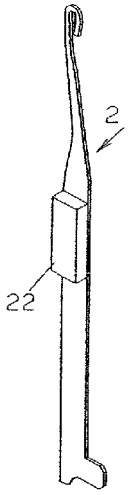
FIG. 7 illustrates a fourth embodiment of a knitting needle

FIG. 7 differs from the embodiment according to FIG. 6 in that only one single part 22 is attached to a side flank of knitting needle 2 as filling element 18.

Figure 8:
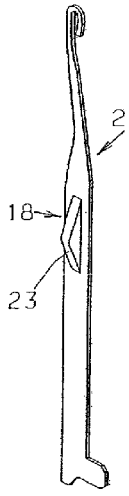
FIG. 8 illustrates a fifth embodiment of a knitting needle.

In the embodiment according to FIG. 8, knitting needle 2 has a stamped form 23 that forms filling element 18. This stamping extends only over one side, and no increase in mass is produced because stamping 23 is formed from the material of knitting needle 2.

Figure 9:
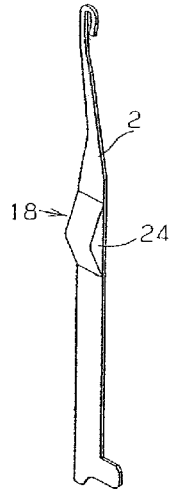
FIG. 9 illustrates a sixth embodiment of a knitting needle.

In the embodiment according to FIG. 9, knitting needle 2 has an embossing 24 that forms filling element 18.

In a manner not shown in further detail, a further possibility lies in connecting two or more knitting needles with a type of plastic web while at the same time fixing knitting needles 2 at a predetermined spacing with respect to one another.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A knitting tool arrangement comprising:

a tool holder having several parallel grooves;

several knitting tools, in which each knitting tool includes a working end and a holding area that is removably positioned in one of the several grooves; and at least one filling element being located on at least one of the knitting tools above the holding area and between adjacent knitting tools so that a thickness of the at least one filling element is greater than a thickness of the holding area.

2. The arrangement in accordance with claim 1, wherein the at least one filling element is structured to fill, with an allowance, a clearance between the adjacent knitting tools.

3. The arrangement in accordance with claim 1, wherein the at least one filling element is arranged on a side flank of the knitting tool, whereby an other side flank is free of the at least one filling element.

4. The arrangement in accordance with claim 1, wherein the at least one filling element is attached to the knitting tool.

5. The arrangement in accordance with claim 4, wherein the at least one filling element comprises two filling elements located on side flanks of the knitting tool to face away from one another.

6. The arrangement in accordance with claim 1, wherein the at least one filling element is formed by a thickening of the knitting tool.

7. The arrangement in accordance with claim 1, wherein the at least one filling element is shaped out of the knitting tool.

8. The arrangement in accordance with claim 1, wherein the at least one filling element comprises at least two filling elements connected to one another.

9. The arrangement in accordance with claim 1, wherein the at least one filling element bears against the tool holder.

10. A knitting tool comprising:

two side flanks;

a holding area;

a working end; and at least one filling element located on at least one of the two side flanks, between the holding area and the working end, and outside of the holding area, wherein a thickness of the at least one filling element is greater than a thickness of the holding area.

11. The knitting tool in accordance with claim 10, wherein the at least one filling element is formed by a thickening of the side flanks.

12. The knitting tool in accordance with claim 10, wherein the at least one filling element is at least one of clipped, adhered, sprayed, soldered or welded onto the at least one of the two side flanks.

13. The knitting tool in accordance with claim 10, wherein the at least one filling element is shaped out of the two side flanks.

14. The knitting tool in accordance with claim 10, wherein the at least one filling element is structured and arranged to leave one of the two flanks free.

15. A method of forming a knitting tool arrangement, comprising:

forming at least one filling element on each of a plurality of knitting tools, the at least one filling element being formed between a working end and a holding area of the knitting tools to have a thickness greater than a thickness of the holding area; and positioning the plurality of knitting tools into a plurality of grooves in a tool holder so that the at least one filling element is located between adjacent knitting tools.

16. The method in accordance with claim 15, wherein each of the plurality of knitting tools have two side flanks, and the forming of the at least one filling element comprises forming one filling element on only one of the two side flanks.

17. The method in accordance with claim 15, wherein each of the plurality of knitting tools have two side flanks, and the forming of the at least one filling element comprises forming one filling element on each of the two side flanks.

18. The method in accordance with claim 15, wherein the forming of the at least one filling element comprises shaping the at least one filling element from the knitting tool.

19. The method in accordance with claim 15, wherein each of the plurality of knitting tools includes a foot extending from an end of the holding area opposite the at least one filling element, and wherein the tool holder comprises a projection in which the plurality of grooves are formed, and the projection has a length, in a direction of the grooves, corresponding to a distance between a top of the foot and a surface of the at least one filling element facing the foot, in order to clamp the knitting tools into the grooves of tool holder.

20. The arrangement in accordance with claim 1, wherein the at least one filling element is positionable to contact a portion of the tool holder located above the several grooves.

21. The knitting tool in accordance with claim 10, wherein the at least one filler element extends outwardly from the at least one side flank beyond the holding area.

22. The method in accordance with claim 15, wherein when the plurality of knitting tools are positioned in the plurality of grooves, the at least one filler elements contacts a portion of the tool holder located above the plurality of grooves.

23. The arrangement in accordance with claim 1, wherein, under lateral tensile force, the adjacent knitting tools support one another through the at least one filling element.

24. The method in accordance with claim 15, wherein, under lateral tensile force, the adjacent knitting tools support one another through the at least one filling element.

25. The arrangement in accordance with claim 1, wherein the at least one filling element is at least one of clipped, adhered, sprayed, soldered or welded onto the knitting tool.

* * * * *